US006311439B1

(12) United States Patent
Arcati et al.

(10) Patent No.: US 6,311,439 B1
(45) Date of Patent: Nov. 6, 2001

(54) WINDOW FRAME

(76) Inventors: Thomas Arcati, 12 Knutson Ct., Huntington, NY (US) 11743; John L. Arcati, 17 Darius Ct., Dix Hills, NY (US) 11746

( * ) Notice: Subject to any disclaimer, the term of this patent is extended or adjusted under 35 U.S.C. 154(b) by 0 days.

(21) Appl. No.: 09/399,467

(22) Filed: Sep. 20, 1999

Related U.S. Application Data

(63) Continuation-in-part of application No. 08/938,983, filed on Sep. 26, 1997, now abandoned.

(51) Int. Cl.[7] ..... E06B 3/32

(52) U.S. Cl. ..... 52/204.51; 52/656.6

(58) Field of Search ..... 52/204.5, 204.51, 52/207, 656.5, 656.6

(56) References Cited

U.S. PATENT DOCUMENTS

| | | | |
|---|---|---|---|
| D. 216,955 | | 3/1970 | Dallaire . |
| D. 216,956 | | 3/1970 | Dallaire . |
| D. 226,904 | | 5/1973 | Dallaire . |
| D. 243,674 | | 3/1977 | Dallaire . |
| D. 243,683 | | 3/1977 | Dallaire . |
| D. 243,684 | | 3/1977 | Dallaire . |
| D. 245,707 | | 9/1977 | Dallaire . |
| D. 250,603 | | 12/1978 | Roesch . |
| D. 261,305 | | 10/1981 | Schmidt . |
| D. 261,310 | | 10/1981 | Schmidt . |
| D. 261,311 | | 10/1981 | Schmidt . |
| D. 267,746 | | 1/1983 | Schmidt . |
| D. 270,569 | | 9/1983 | Cascone et al. . |
| D. 285,611 | | 9/1986 | Slocomb, Jr. . |
| D. 301,067 | | 5/1989 | Dallaire et al. . |
| D. 327,745 | | 7/1992 | Valentin . |
| D. 330,264 | | 10/1992 | Valentin . |
| D. 339,874 | | 9/1993 | Cole . |
| D. 341,437 | | 11/1993 | Cole . |
| D. 343,462 | | 1/1994 | Cole . |
| D. 345,019 | | 3/1994 | Cole . |
| D. 351,663 | | 10/1994 | Cole . |
| D. 363,357 | | 10/1995 | Franson . |
| D. 365,644 | | 12/1995 | Cole . |
| D. 366,325 | | 1/1996 | Schrader . |
| D. 366,326 | | 1/1996 | Schrader . |
| D. 366,330 | | 1/1996 | Franson . |
| D. 369,418 | | 4/1996 | Franson . |
| D. 369,419 | | 4/1996 | Franson . |
| D. 372,108 | | 7/1996 | Franson . |
| D. 372,315 | | 7/1996 | Schrader . |
| D. 372,543 | | 8/1996 | Oliver . |
| 685,647 | | 10/1901 | Sborigi . |
| 2,231,245 | * | 2/1941 | Blackburn ..... 52/204.5 |
| 2,264,187 | | 11/1941 | Owen . |
| 3,101,820 | | 8/1963 | Snyder et al. . |
| 3,208,110 | * | 9/1965 | Griffin ..... 52/207 X |
| 3,214,873 | | 11/1965 | Davis . |
| 3,239,976 | | 3/1966 | Hall . |

(List continued on next page.)

*Primary Examiner*—Michael Safavi
(74) *Attorney, Agent, or Firm*—Dilworth & Barrese, LLP

(57) ABSTRACT

An aluminum window frame construction which includes: an outer frame having a header, a sill and first and second jambs. At least one sash frame assembly is mounted in the outer frame, including a top portion, a bottom portion and first and second side portions. The frame is formed with radiused corners to enhance strength and such that a sight-line of about 2¾ inches is created at a top of the window frame construction when the top portion of the sash frame assembly is positioned in abutment with the header. A sight-line of about 3⅜ inches is created at a bottom of the window frame construction when the bottom portion of the sash frame assembly is positioned in abutment with the sill, and a sight-line of about 2⅜ inches to about 2¾ inches is created on at least one side of the window frame construction when one of the first and second side portions of the sash frame assembly is positioned in abutment with one of the first and second jambs.

19 Claims, 7 Drawing Sheets

U.S. PATENT DOCUMENTS

| | | | | |
|---|---|---|---|---|
| 3,334,463 | | 8/1967 | Muessel . | |
| 3,344,575 | | 10/1967 | Grossman . | |
| 3,389,527 | * | 6/1968 | Collard | 52/656.6 X |
| 3,528,692 | | 9/1970 | De Vries . | |
| 3,866,373 | | 2/1975 | Hudock . | |
| 4,048,774 | | 9/1977 | Yamamoto . | |
| 4,110,942 | | 9/1978 | Slocomb, Jr. . | |
| 4,229,905 | * | 10/1980 | Rush | 52/207 X |
| 4,304,081 | | 12/1981 | Dawson . | |
| 4,356,667 | | 11/1982 | Malachowski . | |
| 4,400,026 | | 8/1983 | Brown, Jr. . | |
| 4,553,367 | | 11/1985 | Redien . | |
| 4,555,884 | | 12/1985 | van Eerden . | |
| 4,612,743 | | 9/1986 | Sälzer . | |
| 4,622,778 | | 11/1986 | Simpson . | |
| 4,628,648 | | 12/1986 | Winyard . | |
| 4,669,765 | | 6/1987 | Ullman . | |
| 4,689,933 | | 9/1987 | Biro . | |
| 4,803,809 | * | 2/1989 | Takemura | 52/207 X |
| 4,837,975 | | 6/1989 | Simpson . | |
| 4,924,631 | | 5/1990 | Davies et al. . | |
| 4,949,506 | | 8/1990 | Durham, Jr. . | |
| 4,958,468 | | 9/1990 | Nolan . | |
| 4,974,364 | | 12/1990 | Durham, Jr. . | |
| 4,979,346 | | 12/1990 | Pollard . | |
| 4,991,369 | * | 2/1991 | Lamb | 52/207 X |
| 5,090,168 | | 2/1992 | Fast et al. . | |
| 5,096,240 | | 3/1992 | Schulz . | |
| 5,099,624 | | 3/1992 | Valentin . | |
| 5,115,610 | | 5/1992 | Kessler . | |
| 5,121,951 | | 6/1992 | Harbom et al. . | |
| 5,139,291 | | 8/1992 | Schulz . | |
| 5,165,737 | | 11/1992 | Riegelman . | |
| 5,280,686 | * | 1/1994 | Davies | 52/207 X |
| 5,560,149 | | 10/1996 | Lafevre . | |
| 5,618,067 | | 4/1997 | Carlson et al. . | |

* cited by examiner

WINDOW FRAME

CROSS REFERENCE TO RELATED APPLICATIONS

This application is a continuation-in-part of U.S. application Ser. No. 08/938,983 filed Sep. 26, 1997 now abandoned, which is incorporated herein by reference.

BACKGROUND

1. Technical Field

The present disclosure relates to window frames, and more particularly to commercial grade window frames having structural enhancements which optimize the window sight lines.

2. Description of the Related Art

A wide variety of window system constructions are known in the art. More specifically, single hung, double hung and fixed glazed windows, for example, are commonly used in both residential and commercial applications. The term "single hung" refers to a window design in which the outer frame contains a fixed glazed region and a slidable sash frame movable relative thereto. The term "double hung" refers to a window design having two relatively movable sash frames and no fixed glazed region. Furthermore, slidable sashes may move vertically or horizontally.

To attain a commercial rating, windows must meet or exceed various performance requirements as measured in various tests. For example, the windows are subjected to tests which measure operating force, deglazing, air and water infiltration and structural loads. The criteria for such tests are established by the American Architectural Manufacturers Association ("AAMA") in "Voluntary Specifications for Aluminum, Vinyl and Wood Windows and Glass Doors", published Mar. 1, 1997. The entire contents of these specifications are hereby incorporated by reference. Such test criteria have made it difficult to design commercial rated windows that have narrow sight lines. Accordingly, there is a continuing need for window systems which have as narrow a sight line as possible while remaining within the criteria established for a commercial rating.

Another feature of window frame constructions is the ability of windows to tilt inward to facilitate cleaning of the external side of the sash from the inside of the building. To accomplish this feature, a tilt latch mechanism is typically provided on top of the sash frame. For example, U.S. Pat. No. 4,356,667 to Malachowski discloses a tilt latch for a slidable window sash, wherein the latch engages a vertical channel in the side of the frame until it is movably lifted out of the channel; U.S. Pat. No. 4,400,026 to Brown, Jr. discloses a tilt latch comprising a slide member and resilient biasing means to urge the slide member in a locking position; U.S. Pat. No. 5,139,291 to Schultz discloses a flush mount tilt latch for a sash window; and U.S. Pat. No. 5,618,067 to Carlson et al. discloses a tilt latch device which may be molded in a one-piece construction to minimize the number of parts associated therewith.

However, a problem commonly encountered with conventional latch mechanisms is that they may inadvertently become unlatched leaving the window free to tilt inward. Accordingly, a need exists for an improved tilt latch mechanism which will prevent inadvertent opening of a window.

SUMMARY OF THE INVENTION

It is an object of the present disclosure to provide a window frame which has a narrow sight line and a commercial rating.

It is another object of the present disclosure to provide a tilt latch mechanism which overcomes the problems associated with conventional tilt latch mechanisms. The tilt latch mechanism of the present disclosure includes a feature which eliminates the possibility of a person inadvertently releasing the latch which will allow the window to tilt inward. An affirmative act must be performed to rotate a latch component to release the tilt latch mechanism.

The present disclosure provides an aluminum window frame construction meeting the specifications for a commercial grade rating, which includes: an outer frame having a header, a sill and first and second jambs; and at least one sash frame assembly mounted in the outer frame, including a top portion, a bottom portion and first and second side portions, such that a sight-line of about 2¾ inches is created at a top of the window frame construction when the top portion of the sash frame assembly is positioned in abutment with the header, a sight-line of about 3⅜ inches is created at a bottom of the window frame construction when the bottom portion of the sash frame assembly is positioned in abutment with the sill, and a sight-line of about 2⅜ inches to about 2¾ inches is created on at least one side of the window frame construction when one of the first and second side portions of the sash frame assembly is positioned in abutment with one of the first and second jambs.

The present disclosure further provides an aluminum window frame construction, wherein the window frame includes first and second sash frame assemblies each having a top portion, a bottom portion and first and second side portions, such that a sight-line of about 1⅞ inches is created by an overlap of the bottom portion of the first sash frame assembly and the top portion of the second sash to frame assembly. The first and second sash frame assemblies may be mounted in the outer frame for relative vertical movement therein.

In a further embodiment, the present disclosure provides an aluminum window frame construction meeting the specifications for a commercial grade rating, which includes an outer frame having a header, a sill and first and second jambs; and a pair of double-hung window frame assemblies connected in a side by side manner, each double-hung window frame assemblies including two sash frame assemblies, wherein each of the two sash frame assemblies includes a top portion, a bottom portion and first and second side portions, such that a sight-line of about 4⅞ inches is created by the juxtaposition of the second side portion of one of the sash frames of the first pair of double-hung window frame assemblies and the first side portion of one of the sash frames of the second pair of double-hung window frame assemblies, a sight-line of about 2¾ inches is created by the top portion of at least one of the sash frames and the header of the outer frame when the top portion of at least one of the sash frame assemblies is positioned in abutment with the header, a sight-line of about 3⅜ inches is created by the bottom portion of at least one of the sash frame assembles and the of the outer frame when the bottom portion of the at least one of the sash frame assemblies is positioned in abutment with the sill, and a sight-line of about 2¾ inches is created on a side of the window frame construction by the first side portion of at least one of the sash frames and the first jamb of the outer frame when the first side portion is positioned in abutment with the first jamb. Typically, at least one of the pair of double-hung window assemblies is configured for relative vertical movement of the sash frame to assemblies.

In yet another embodiment, the present disclosure provides an aluminum window frame construction meeting the specifications for a commercial grade rating, which includes an outer frame having a header, a sill and first and second jambs; a first window frame assembly including two sash frame assemblies each of which includes a top portion, a bottom portion and first and second side portions; and a second window frame assembly which includes a sash frame assembly having a top portion, a bottom portion and first and second side portions, wherein the first and second window frame assemblies are connected such that a sight-line of about 4 inches is created between the first side portion of at least one of the two sash frame assemblies of the first window frame assembly and the second side portion of the sash frame assembly of the second window frame assembly, a sight-line of about 2¾ inches is created by the top portion of at least one of the sash frame assemblies of either the first window frame assembly or the second window frame assembly when the top portion of the sash frame assembly is positioned in abutment with the header, a sight-line of about 3⅜ inches is created by the bottom portion of at least one of the sash frame assemblies of either the first window frame assembly or the second window frame assembly when the when the bottom portion of the sash frame assembly is positioned in abutment with the sill, a sight-line of about 2⅜ inches to about 2¾ inches is created on at least one side of the window frame construction when the first side portion of one of the sash frame assemblies from at least one of the first window frame assembly and the second window frame assembly is positioned in abutment with the first jamb, and the first window assembly has a sight-line of about 1⅞ inches which is created by the overlap of the bottom portion of one of the two sash frame assemblies and the top portion of the other of the two sash frame assemblies. The first and second sash frame assemblies may be mounted in the outer frame for relative vertical movement therein.

These and other objects, features and advantages of the present disclosure will become apparent from the following detailed description of illustrative embodiments, which is to be read in connection with the accompanying drawings.

BRIEF DESCRIPTION OF THE DRAWINGS

For a better understanding of the presently disclosed window frame, reference is made to the following description of exemplary embodiments thereof, and to the accompanying drawings, wherein.

DETAILED DESCRIPTION OF THE PREFERRED EMBODIMENTS

Figure 1:
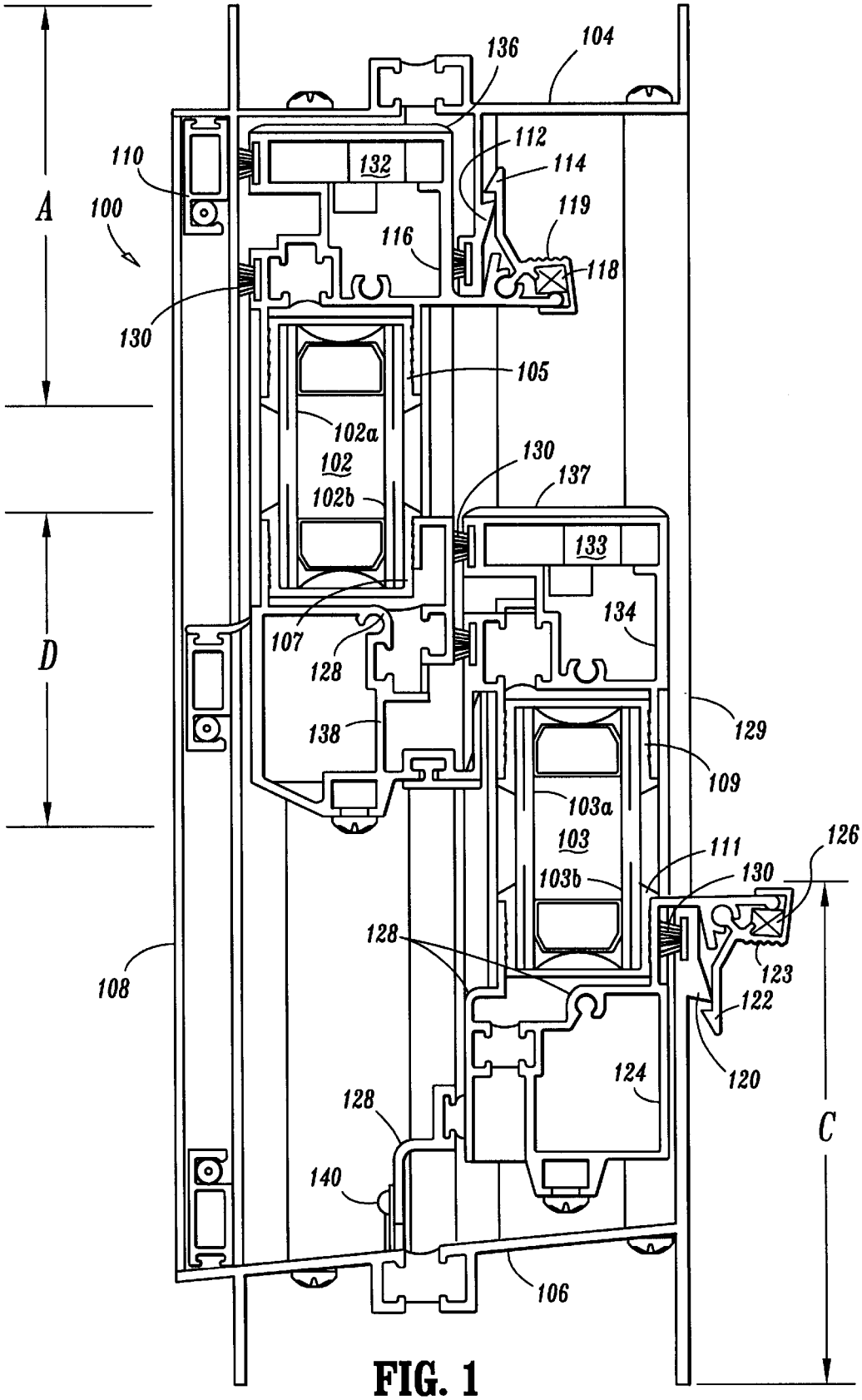
FIG. 1 is a side cross-sectional view of a double-hung window frame constructed in accordance with an embodiment of the present disclosure.

Referring now the drawings in detail in which like reference numerals refer to similar or identical elements, and initially to FIG. 1, a first embodiment constructed in accordance with the presently disclosed window system is designated generally as window configuration 100. Window 100 basically includes exterior and interior window sashes 102 and 103, respectively, and has an upper end and a lower end and is designed to be installed in a rough opening formed in a wall.

In the illustrated embodiment, sashes 102 and 103 are shown having double glazing, i.e., glass panels 102*a*, 102*b* and 103*a*, 103*b*, respectively. However, it is within the scope of the present disclosure that different glazing configurations may also be utilized. For example, single or triple glazed windows are also within the scope of the present disclosure.

The various embodiments of the presently disclosed window system utilize aluminum for frame components and are designed to meet or exceed commercial ratings grade, as set forth by the AAMA.

The upper end of window 100 is shown as header 104, and the lower end is shown as sill 106. Sill 106 is advantageously sloped downward toward an exterior side 108 of window frame 100, such that fluids, typically rain water, hitting any portion of the window frame will drain off sill 106 to the exterior of the wall in which the window frame is installed. A screen assembly 110 is preferably mounted on exterior side 108 to allow a user to open at least one of the sashes 102 and 103 while still providing screening protection to the atmosphere inside the building.

Header 104 includes a catch member 112 extending vertically downward from an intermediate portion thereof. A mating catch 114 extends vertically upward from a horizontal portion of top rail 116. A spring 118 (shown schematically) is provided to bias catch 114 in a locked position such that catch 114 engages catch 112 when window sash 102 is in its fully closed position. In order to open sash 102 the user must first disengage catches 112 and 114 by pushing downwardly on knurled surface 119 of catch 114. Due to the pivotal mounting of catch 114 such a downward force will provide clearance between catches 112 and 114 thereby permitting sash 102 to be moved downwardly. Similarly, sill 106 includes a catch 120 extending vertically upward from an interior side 129 thereof. A mating catch 122 extends vertically downward from a horizontal portion of bottom rail 124. A latch spring 126 (shown schematically) is provided to bias catch 122 in a direction toward exterior side 108, such that catch 122 engages catch 120 when interior sash 103 is in its fully closed position. Operation of catch 122 is the same as that described above for catch 114 except that an upwardly diverted force must be applied to knurled surface 123 to overcome the bias of spring 126.

Figure 2:
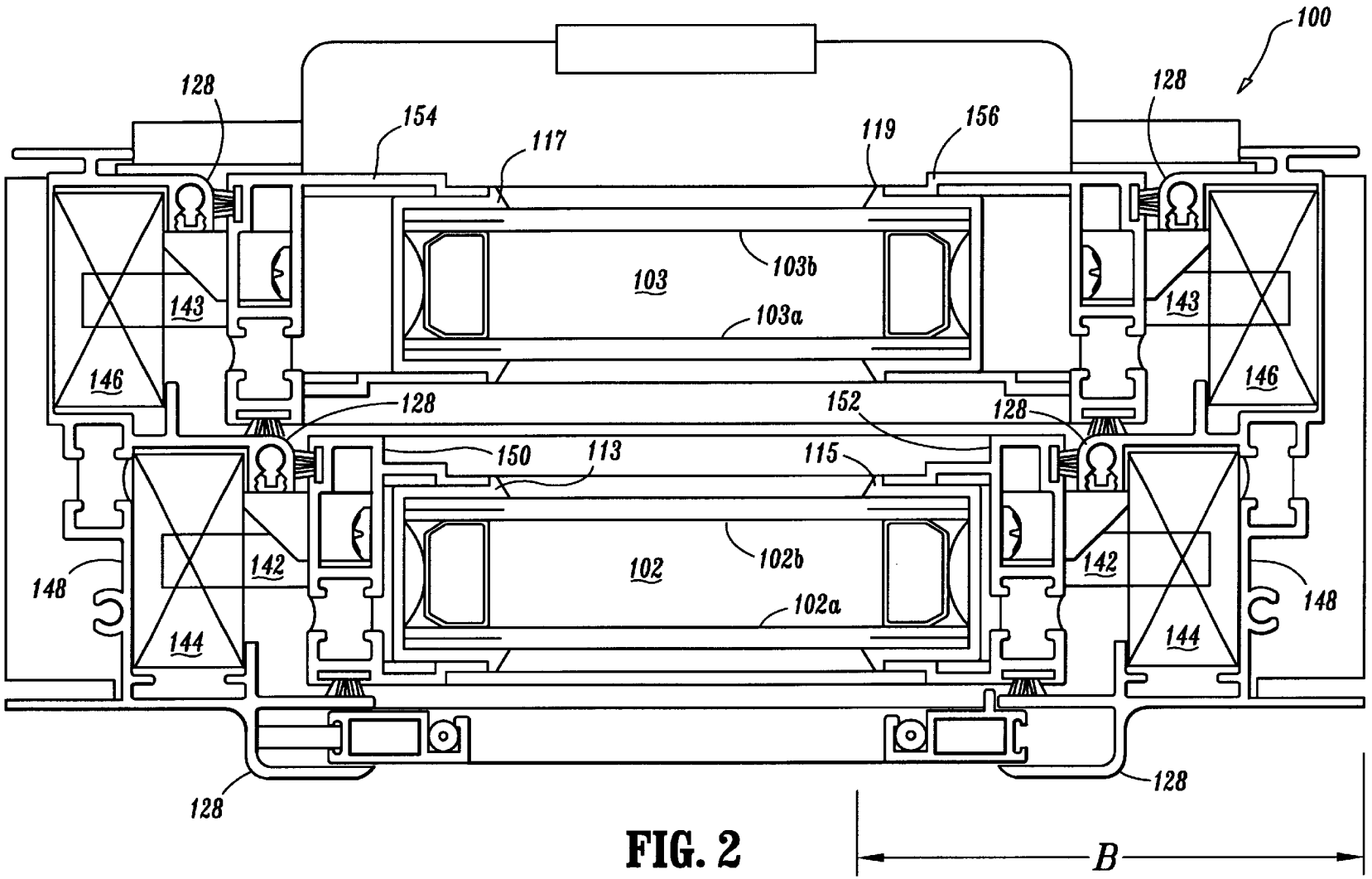
FIG. 2 is a top cross-sectional view of the window frame of FIG. 1.

As illustrated in FIGS. 1 and 2, the perimeters of glazings 102*a*, 102*b*, 103*a*, 103*b* are encased by glazing supports such as sealing gaskets 105, 107, 109, 111, 113, 115, 117 and 119. The gaskets are further supported by top, bottom and side portions such as top rail 116, bottom rail 138, left stile 150, and right stile 152 of sash 102; and top rail 134, bottom rail 124, left stile 154 and right stile 156 of sash 103, which allow for slidable motion of the glazings relative to header 104, sill 106 and side jambs 148. The combination of the gaskets and their respective rail members comprise the sash frame assemblies. Preferably, the sash frame assemblies are configured such that, for example a sight-ine "A" of about 2¾ inches is created at a top of the window frame construction when the top rail 116 of the sash frame assembly is positioned in abutment with header 104; a sight-line "B" of about 2¾ inches is created on sides of the window frame construction when stiles 152, 156 (on the right side) and stiles 150, 154 (on the left side) of the sash frame assembly are positioned in abutment with the side jamb; a sight-line "C" of about 3⅜ inches is created at a bottom of the window frame construction when the bottom rail 124 of the sash frame assembly is positioned in abutment with sill 106; and a sight-line "D" of about 1⅞ inches is created by an overlay of bottom rail 138 of sash frame assembly 102 and top rail 134 of sash frame assembly 103.

A plurality of elongate wool pile brushes 130 are strategically situated between the various rails within window frame 100, to provide a seal therebetween which prevents air infiltration, i.e., drafts around the window panes. The plurality of brushes 130 also reduce the sliding friction which would otherwise exist between the rails.

Tilt latches 132 and 133 are provided on top of rails 116 and 134 to enable a user to tilt sashes 102 and 103 toward the interior of the building to accommodate cleaning of the exterior side of sashes 102 and 103. Sash caps 136 and 137 may be mounted on the top of tilt latches 132 and 133 for aesthetic purposes and to provide a smooth outer top surface on sash 102 and 103.

A keeper rail 138 is provided to support the bottom edge of sash 102. A weep cover 140 extends vertically from an intermediate portion of sill 106 to prevent seepage of water under the bottom portion of bottom rail 124.

The structural features which provide additional strength to the disclosed window frame and which enable the width of the visible frame portion to be greatly reduced relative to conventional commercial windows and, thus, have a narrow sight line, include radii formed in the rail members and additional bracing within the rail members. The plurality of radii 128 are formed during the extrusion of the window frame and advantageously provide structural enhancements, i.e., enhanced strength, which allow frame 100 to have a reduced visible dimension and thus a more narrow sight line. Thus, the quantity of the window opening surface area which is occupied by the frame is minimized, thereby maximizing the glazed surface area. Typically, conventional windows having a commercial rating have fairly thick visible frame widths. Utilizing the presently disclosed frame construction, window frame 100 is formed having visible frame widths disclosed above.

Turning now to FIG. 2, window frame 100 is shown in cross-section from the top. Pivot bars 142 and 143 are provided to allow sashes 102 and 103 to pivot relative to the frame, to allow the window to be cleaned from the interior of the building. Balance shoes 144 and 146 are provided to offset the weight of sashes 102 and 103, respectively. Although shown having balance shoes, the balance system may be designed to accept any balance mechanism known to those of ordinary skill in the art (e.g., single, dual, block and tackle, spiral, ultra lifts and pneumatic).

Jambs 148 are provided on either side of window frame 100 to enable the window to be secured laterally within the rough opening of the building.

Figure 3:
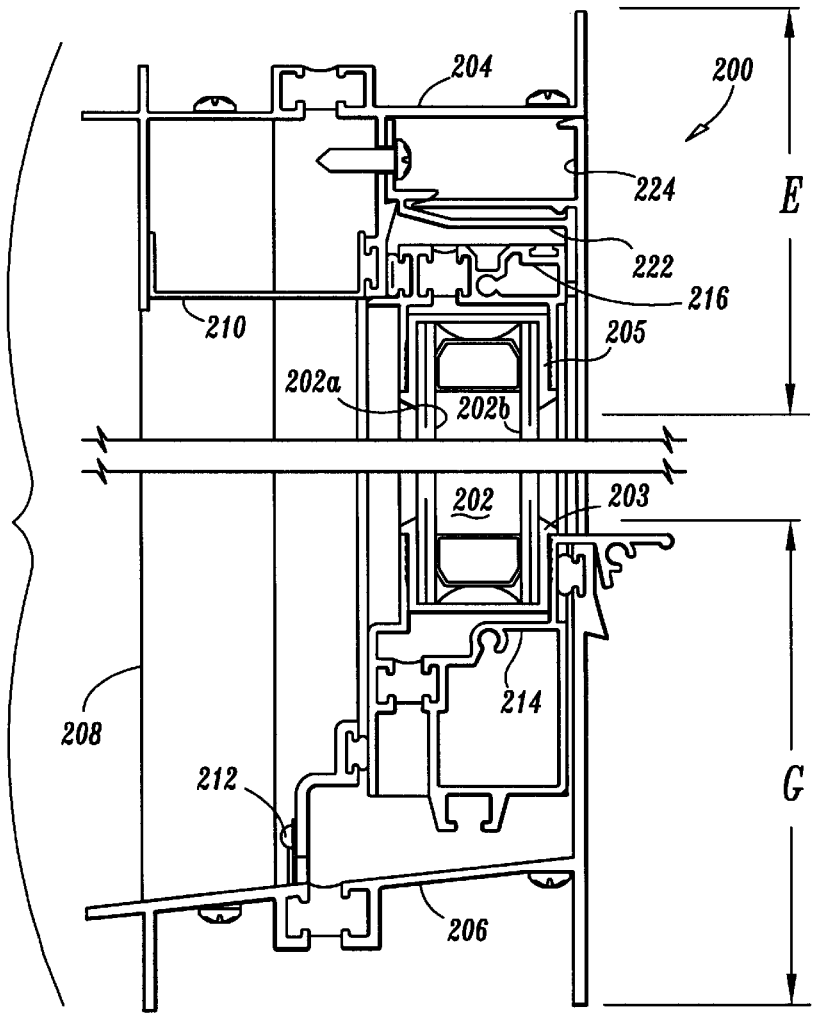
FIG. 3 is a partial side cross-sectional view of a fixed window frame in accordance with another embodiment of the present disclosure.
Figure 4:
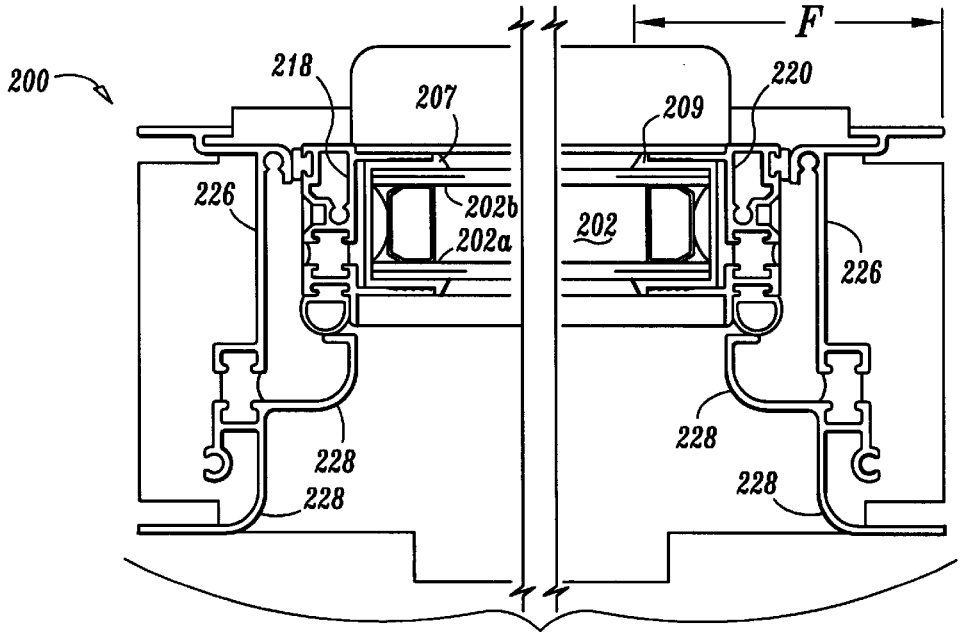
FIG. 4 is a partial top cross-sectional view of the fixed window frame of FIG. 3.

FIGS. 3 and 4 illustrate side and top views of a fixed window frame 200 constructed in accordance with another embodiment of the present disclosure. This type of window frame includes a single fixed sash 202, and is used in applications where ventilation through the space occupied by the frame is not required. The upper end of window frame 200 is defined as a header and is designated by numeral 204, and the lower end is defined as a sill and is designated by numeral 206. Sill 206 is advantageously sloped downward toward an exterior side 208 of window frame 200 such that fluids, typically rain water, hitting any portion of the window frame will drain off sill 206 to the exterior of the wall in which the window frame is installed.

A cover assembly 210 is provided on exterior side 208 to protect window frame 200 from deterioration caused by exposure to varying weather conditions. Cover assembly 210 is preferably formed of polyvinyl chloride or aluminum. A weep cover 212 extends vertically upward from an intermediate portion of sill 206 to prevent seepage of water under the bottom portion of bottom rail 214.

Bottom rail 214 and top rail 216 provide horizontal support to sash 202, and stiles 218 and 220 provide vertical and lateral support. Retainers 222 and 224 are provided to maintain top rail 216 and stiles 218 and 220 in proper alignment.

Jambs 226 are provided on either side of window frame 200 to enable the window frame to be secured laterally within the rough opening of the building.

As illustrated in FIGS. 3 and 4, the perimeters of glazings 202*a* and 202*b*, are encased by glazing supports such as gaskets 203, 205, 207 and 209. The gaskets are further supported by respective rail members 214 and 216, and stiles 218 and 220. The combination of the gaskets and their respective rail and stile members comprise the sash frame assemblies. Preferably, the sash frame assemblies are configured such that: a sight-line "E" of about 2¾ inches is created at a top of the window frame construction; a sight-line "F" of about 2⅜ inches is created on the side portion of the window frame construction; and a sight-line "G" of about 3⅜ inches is created at a bottom of the window frame construction.

A plurality of radii 228 are provided along the vertical edges of the exterior portions of jambs 226. The plurality of radii 228 are formed during the extrusion of the window frame and advantageously provide structural enhancements, i.e., enhanced strength, which allow frame 200 to have a reduced visible dimension and thus a more narrow sight line. Accordingly, the window frame in accordance with the present disclosure is more aesthetically pleasing and provides more light to the interior of a building or room than a conventional commercial grade window frame while still meeting or exceeding the commercial grade ratings.

Figure 5:
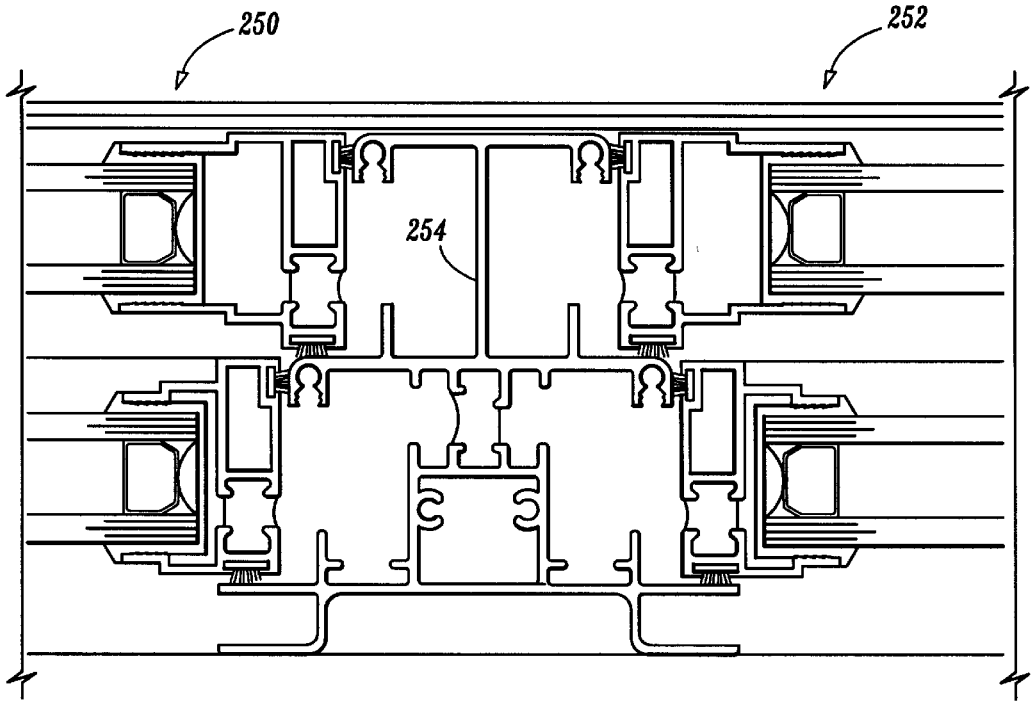
FIG. 5 is a partial top cross-sectional view of a twin double-hung window frame in accordance with another embodiment of the present disclosure.
Figure 6:
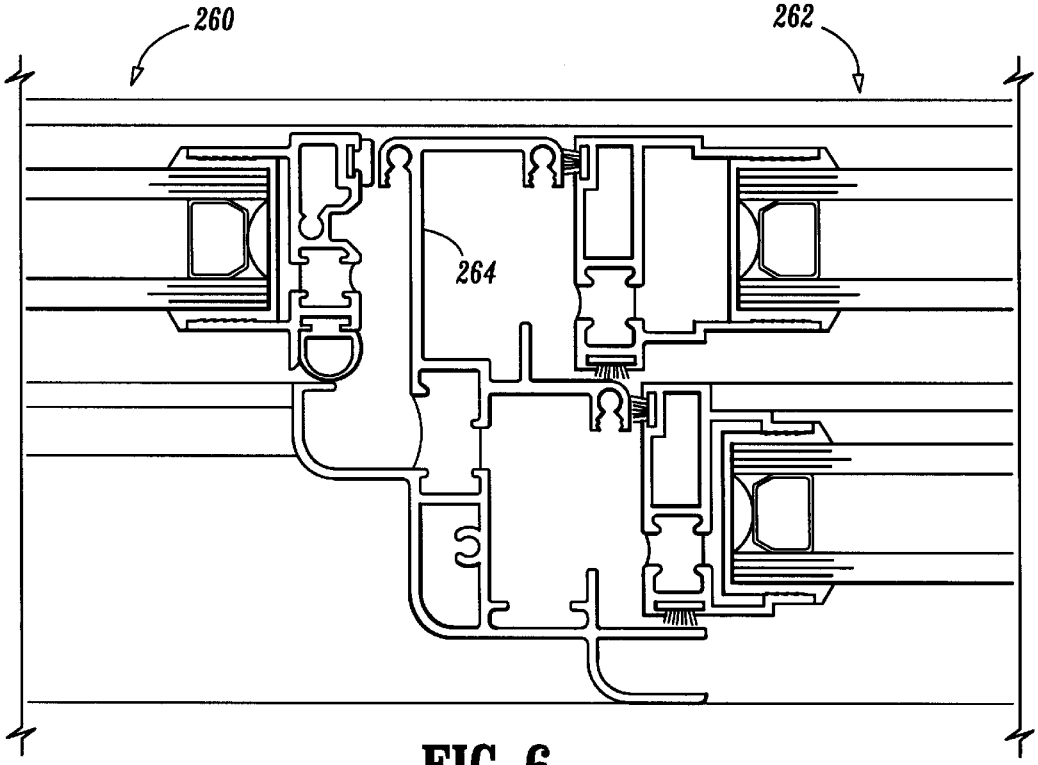
FIG. 6 is a partial top cross-sectional view of a combined fixed/double-hung window frame in accordance with another embodiment of the present disclosure.

FIGS. 5 and 6 illustrate various combinations of the unitary type window frames illustrated in FIGS. 1–4. For example, FIG. 5 is a view of a twin double-hung window frame design which combines two double-hung window frames 250 and 252 as individually described with reference to FIGS. 1 and 2. The two double-hung windows 250 and 252 are joined at a common jamb 254. FIG. 6 is a view of a combination fixed/double-hung window frame design which combines a fixed window frame 260 as described with reference to FIGS. 3 and 4 with a double-hung window frame 262 as described with reference to FIGS. 1 and 2. The fixed window frame 260 and double-hung frame 262 are joined at a common jamb 264. The combination type window frames illustrated in FIGS. 5 and 6 each incorporate the structural enhancements described with reference to the unitary window frames illustrated in FIGS. 1–4.

Figure 7:
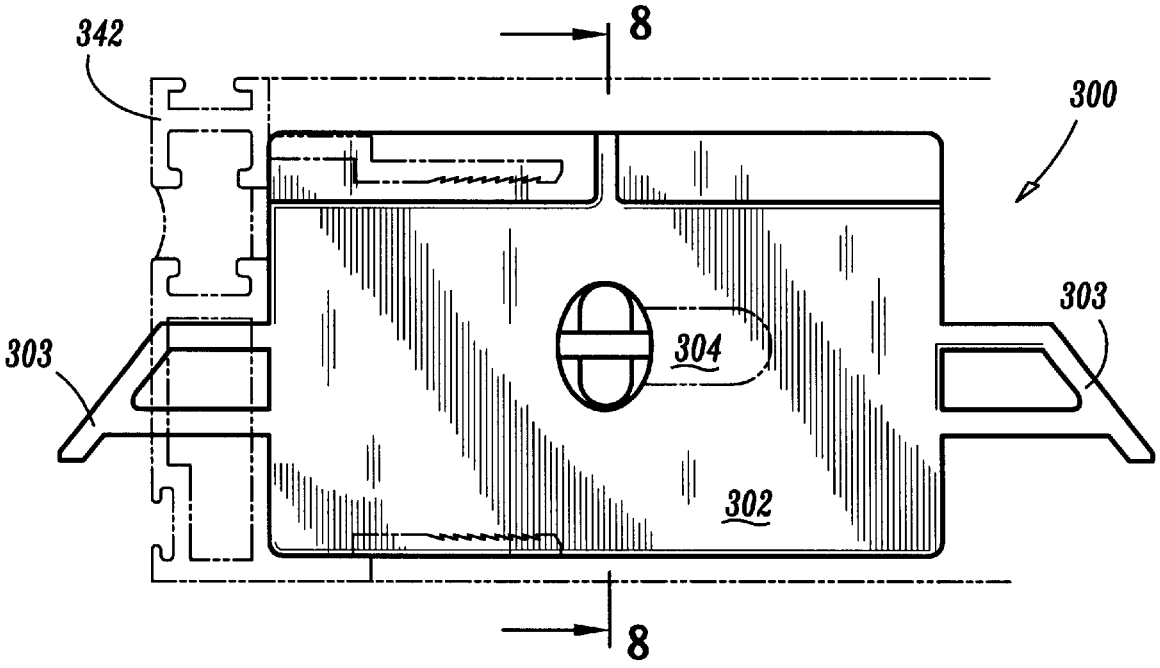
FIG. 7 is a top view of a window latch mechanism.
Figure 8:
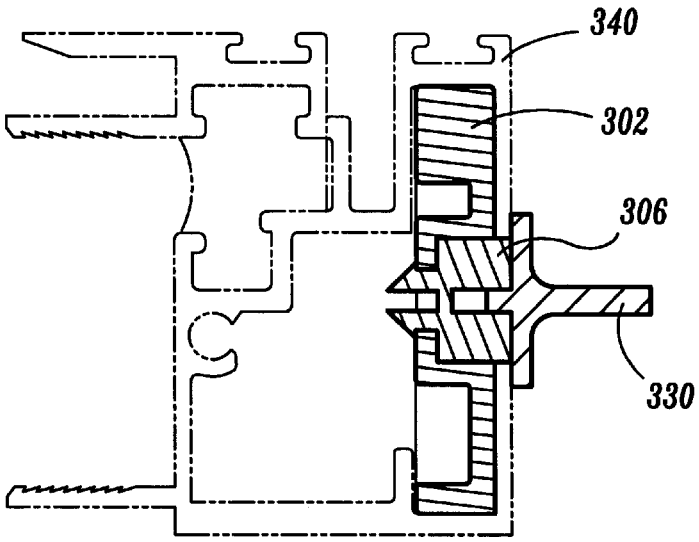
FIG. 8 is a cross-sectional view of the window latch mechanism of FIG. 7, along line 8—8.

Referring now to FIGS. 7 and 8, a tilt latch mechanism 300 is provided for use with window styles having the capability of tilting the sashes to permit access to the exterior sides of the glass pane for cleaning or maintenance. Tilt latch mechanism 300 is mounted, for example, within a top rail of double-hung type windows, as shown in FIG. 1 and designated by numbers 132 and 133. Tilt latch mechanism 300 includes a substantially rectangular base member 302 and at least one tab 303 extending laterally therefrom for engaging a portion of a side rail 342 to prevent a sash from tilting. Tilt latch mechanism 300 may also include means for biasing tab 303 toward side rail 342. As illustrated in FIG. 8, tilt latch mechanism 300 is slidably mounted within a top rail member 340.

Figure 11:
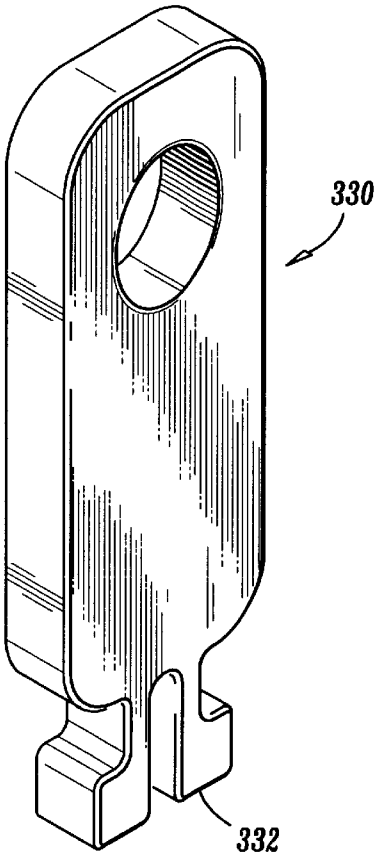
FIG. 11 is a perspective view of the window latch mechanism key of FIG. 9.
Figure 13:
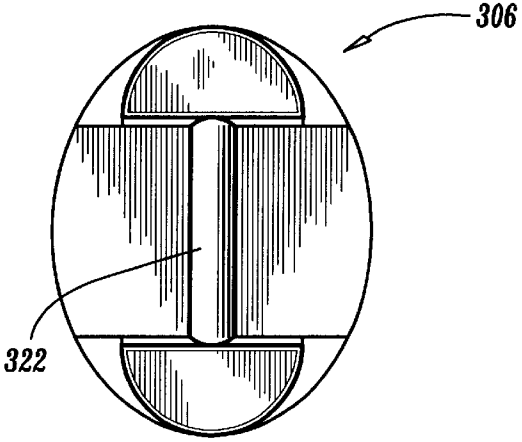
FIG. 13 is a front view of the latch component of FIG. 12.
Figure 14:
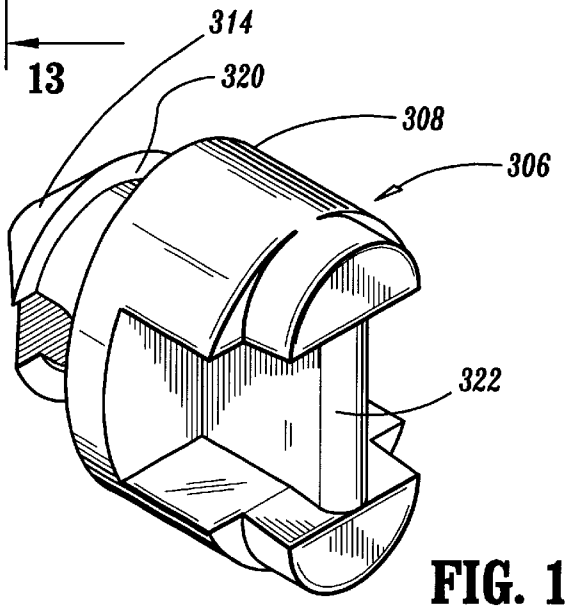
FIG. 14 is a perspective view of the latch component of FIG. 12.
Figure 12:
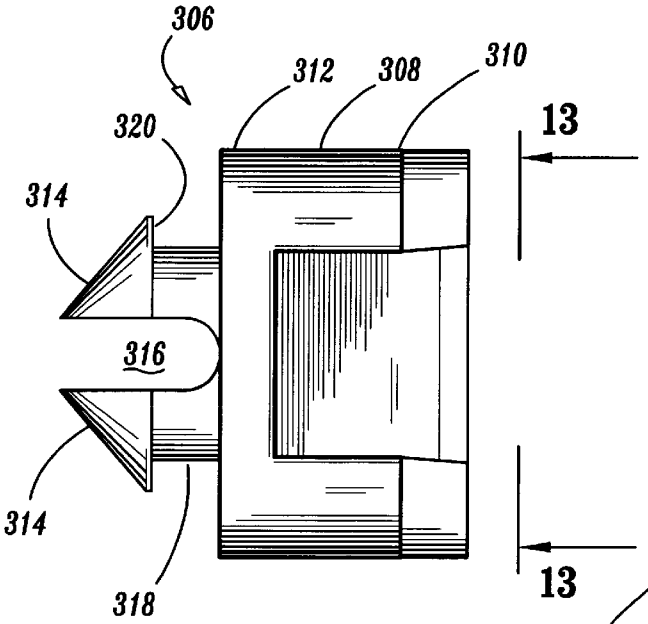
FIG. 12 is a side view of the latch component of a window latch mechanism.

A latch component 306, illustrated in detail in FIGS. 12–14, is positioned in slot 304 formed in top rail 340. Latch component 306 has a substantially elliptical body portion 308 with an upper portion 310 and a lower portion 312. A pair of parallel semi-elliptical finger members 314 extend substantially vertical from lower portion 312. Finger members 314 are separated by a substantially U-shaped channel 316 which provides an advantageous degree of flexibility to the finger members. Finger members 314 also have a circumferential groove 318 formed therein adjacent lower portion 312 of body portion 308. Shoulder 320 is formed by circumferential groove 318 which permits the finger members to snap fit into position in a hole formed in base member 302. Upper portion 310 has a notch on either side forming a longitudinal substantially rectangular center portion 322 and is thus configured to receive a key 330, as illustrated in FIGS. 9–11, to facilitate a rotational motion of latch component 306.

Figure 10:
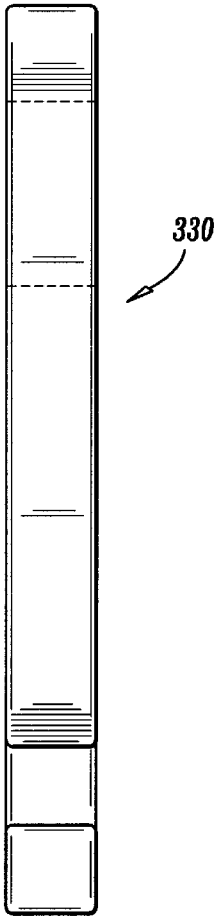
FIG. 10 is a side view of the window latch mechanism key of FIG. 9.
Figure 9:
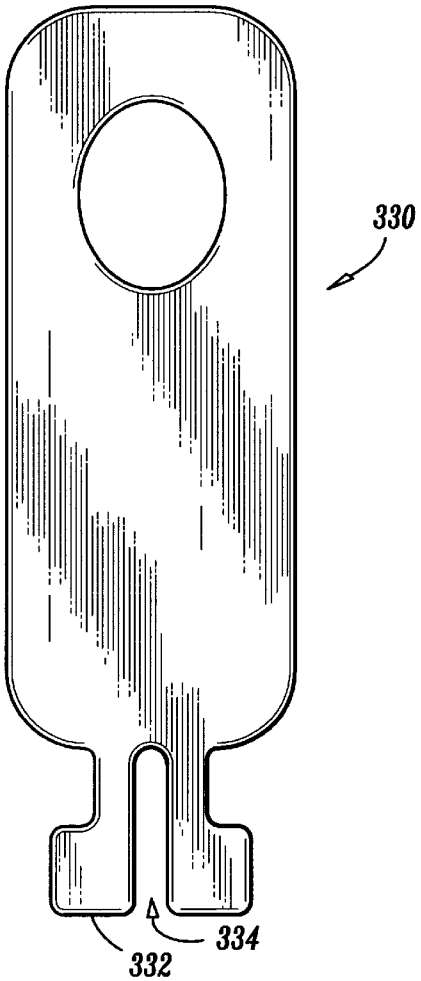
FIG. 9 is a front view of a window latch mechanism key.

Key 330, illustrated in FIGS. 9–11, is configured to engage latch component 306 to facilitate rotation thereof. Key 330 is substantially rectangular and includes a pair of parallel vertical legs 332 defining a U-shaped channel 334. The width of channel 334 corresponds to the width of center portion 322 on latch component 306, such that legs 332 straddle center portion 322 to facilitate rotational movement thereof. Once latch component 306 is properly aligned in slot 304, as discussed below, key 330 may be used to move tilt latch mechanism 300 in the lateral direction to disengage side rail 342. Key 330 is preferably formed of a rigid zinc die cast.

Latch component 306 is typically in one of two substantially orthogonal positions. A first position corresponds to a locked position, as shown in FIG. 7, and a second position corresponds to a position which allows latch component 300 to slide in a lateral direction to disengage side rail 342. The first locked position is accomplished by the configuration of latch component 306 within slot 304. As seen in FIG. 7, slot 304 is configured and dimensioned to have an elliptical portion and a circular portion, the two portions being in communication with each other. As discussed above, the upper portion 310 of latch component 306, which extends into slot 304, has a substantially elliptical shape. Therefore, the first locked position is accomplished by turning latch component so that it is substantially perpendicular to the elliptical portion of slot 304, as shown in FIG. 7. In this position, the tilt latch mechanism is fixed in an extended locking position and the latch cannot be inadvertently disengaged, thereby precluding accidental inward pivoting of the window sash. When latch component is turned to the second position which is substantially orthogonal to the first position, the elliptical latch component 306 will be aligned with the elliptical portion of slot 304 to allow lateral movement of the tilt latch mechanism. The lateral movement will cause tab 303 to disengage side rail thereby allowing the window sash to pivot inward.

Although the illustrative embodiments of the present invention have been described herein with reference to the accompanying drawings, it is to be understood that the invention is not limited to those precise embodiments, and that various other changes and modifications may be affected therein by one skilled in the art without departing from the scope or spirit of the invention. All such changes and modifications are intended to be included within the scope of the invention as defined by the appended claims.

What is claimed is:

1. An aluminum window frame construction, which comprises:

an outer frame having a header, a sill and first and second jambs, the outer frame having a plurality of radiused corners to provide enhanced strength and a narrow sight line, each of the radiused corners having inner and outer radiused surfaces; and at least one sash frame assembly mounted in the outer frame, and including a top portion, a bottom portion and first and second side portions, such that a sight-line of about 2¾ inches is created at a top of the window frame construction when the top portion of the sash frame assembly is positioned in abutment with the header.

2. An aluminum window frame construction according to claim 1, wherein a sight-line of about 3⅜ inches is created at a bottom of the window frame construction when the bottom portion of the sash frame assembly is positioned in abutment with the sill.

3. An aluminum window frame construction according to claim 1, wherein a sight-line of about 2⅜ inches to about 2¾ inches is created on at least one side of the window frame construction when one of the first and second side portions of the sash frame assembly is positioned in abutment with one of the first and second jambs.

4. An aluminum window frame construction according to claim 1, wherein the window frame comprises first and second sash frame assemblies each having a top portion, a bottom portion and first and second side portions, such that a sight-line of about 1⅞ inches is created by an overlap of the bottom portion of the first sash frame assembly and the top portion of the second sash frame assembly.

5. An aluminum window frame construction according to claim 4, wherein the first and second sash frame assemblies are mounted in the outer frame for relative vertical movement therein.

6. An aluminum window frame construction according to claim 1, further comprising a tilt latch mechanism mounted within each side of the top portion of the at least one sash frame assembly.

7. An aluminum window frame construction according to claim 6, wherein the tilt latch mechanism includes a substantially rectangular base and at least one tab extending laterally from the base for engaging at least one of the first and second side portions.

8. An aluminum window frame construction, which comprises:

an outer frame having a header, a sill and first and second jambs, the outer frame having a plurality of radiused corners to provide enhanced strength and a narrow sight line, each of the radiused corners having inner and outer radiused surfaces; and a pair of double-hung window frame assemblies connected in a side by side manner, each double-hung window frame assembly including two sash frame assemblies, wherein each of the two sash frame assemblies of each double-hung window frame assembly includes a top portion, a bottom portion and first and second side portions, such that a sight-line of about 4⅞ inches is created by the juxtaposition of the second side portion of one of the sash frames of the first pair of double-hung window frame assemblies and the first side portion of one of the sash frames of the second pair of double-hung window frame assemblies.

9. An aluminum window frame construction according to claim 8, wherein a sight-line of about 2¾ inches is created by the top portion of at least one of the sash frame assemblies and the header of the outer frame when the top portion of at least one of the sash frame assemblies is positioned in abutment with the header.

10. An aluminum window frame construction according to claim 8, wherein a sight-line of about 3⅜ inches is created by the bottom portion of at least one of the sash frame assemblies and the sill of the outer frame when the bottom portion of the at least one of the sash frame assemblies is positioned in abutment with the sill.

11. An aluminum window frame construction according to claim 8, wherein a sight-line of about 2¾ inches is created on a side of the window frame construction by the first side portion of at least one of the sash frames and the first jamb of the outer frame when the first side portion is positioned in abutment with the first jamb.

12. An aluminum window frame construction according to claim 8, further comprising a tilt latch mechanism mounted within each side of the top portion of one of the two sash frame assemblies of each of the double-hung window frame assemblies.

13. An aluminum window frame construction according to claim 12, wherein the tilt latch mechanism includes a substantially rectangular base and at least one tab extending laterally from the base for engaging at least one of the first and second side portions.

14. An aluminum window frame construction, which comprises:

an outer frame having a header, a sill and first and second jambs, the outer frame having a plurality of radiused comers to provide enhanced strength and a narrow sight line, each of the radiused corners having inner and outer radiused surfaces;

a first window frame assembly including two sash frame assemblies each of which includes a top portion, a bottom portion and first and second side portions; and a second window frame assembly which includes a sash frame assembly having a top portion, a bottom portion and first and second side portions, wherein the first and second window frame assemblies are connected such that a sight-line of about 4 inches is created between the first side portion of at least one of the two sash frame assemblies of the first window frame assembly and the second side portion of the sash frame assembly of the second window frame assembly.

15. An aluminum window frame construction according to claim 14, wherein a sight-line of about 2¾ inches is created by the top portion of at least one of the sash frame assemblies of either the first window frame assembly or the second window frame assembly when the top portion of the sash frame assembly is positioned in abutment with the header.

16. An aluminum window frame construction according to claim 14, wherein a sight-line of about 3⅜ inches is created by the bottom portion of at least one of the sash frame assemblies of either the first window frame assembly or the second window frame assembly when the bottom portion of the sash frame assembly is positioned in abutment with the sill.

17. An aluminum window frame construction according to claim 14, wherein a sight-line of about 2⅜ inches to about 2¾ inches is created on at least one side of the window frame construction when the first side portion of one of the sash frame assemblies from at least one of the first window frame assembly and the second window frame assembly is positioned in abutment with the first jamb.

18. An aluminum window frame construction according to claim 14, wherein the first window assembly has a sight-line of about 1⅞ inches which is created by overlap of the bottom portion of one of the two sash frame assemblies and the top portion of the other of the two sash frame assemblies.

19. An aluminum window frame construction according to claim 18, wherein the first and second sash frame assemblies are mounted in the outer frame for relative vertical movement therein.

* * * * *